US009382036B2

(12) United States Patent
Torres et al.

(10) Patent No.: US 9,382,036 B2
(45) Date of Patent: Jul. 5, 2016

(54) ECOLOGICAL PALLET

(71) Applicants: MAC PALLETT S.A., Buenos Aires (AR); Beatriz Marina Viera De Cascelli, Buenos Aires (AR)

(72) Inventors: Jorge A. Torres, Buenos Aires (AR); Juan M. Larrinaga, Buenos Aires (AR)

(73) Assignee: MAC PALLET S.A., Buenos Aires (AR)

( * ) Notice: Subject to any disclaimer, the term of this patent is extended or adjusted under 35 U.S.C. 154(b) by 0 days.

(21) Appl. No.: 14/432,944

(22) PCT Filed: Sep. 18, 2013

(86) PCT No.: PCT/IB2013/058640

§ 371 (c)(1),
(2) Date: Apr. 1, 2015

(87) PCT Pub. No.: WO2014/053937

PCT Pub. Date: Apr. 10, 2014

(65) Prior Publication Data

US 2015/0259095 A1 Sep. 17, 2015

(30) Foreign Application Priority Data

Oct. 1, 2012 (AR) ..... P20120103659

(51) Int. Cl.
*B65D 19/38* (2006.01)
*B65D 19/00* (2006.01)
*B65D 19/36* (2006.01)

(52) U.S. Cl.
CPC ..... *B65D 19/0012* (2013.01); *B65D 19/36* (2013.01); *B65D 2519/00009* (2013.01); *B65D2519/00034* (2013.01); *B65D 2519/00069* (2013.01); *B65D 2519/00273* (2013.01); *B65D 2519/00278* (2013.01); *B65D 2519/00293* (2013.01); *B65D 2519/00343* (2013.01); *B65D 2519/00402* (2013.01); *B65D 2519/00572* (2013.01); *Y10T 29/49826* (2015.01)

(58) Field of Classification Search
CPC ..... B65D 2519/00019
USPC ..... 108/51.11, 51.3, 52.1, 53.1, 53.3, 108/57.17, 57.22, 57.23, 901
See application file for complete search history.

(56) References Cited

U.S. PATENT DOCUMENTS 2,506,346 A * 5/1950 Crawford ..... B65D 19/0081 108/51.3
2,774,490 A * 12/1956 Strong ..... B65D 19/36 108/51.3

(Continued)

FOREIGN PATENT DOCUMENTS

| | | |
|---|---|---|
| EP | 2 316 741 | 5/2011 |
| JP | 61-3226 | 1/1986 |
| WO | WO 2011/039766 | 4/2011 |

OTHER PUBLICATIONS

International Search Report, PCT/IB2013/058640, Feb. 12, 2014.

*Primary Examiner* — Matthew Ing
(74) *Attorney, Agent, or Firm* — Young & Thompson

(57) ABSTRACT

Disclosed is an ecological pallet with two semi-circular support structures, each an elongated arch-shaped structure, with openings located at equidistant distances on one of the sides of each of the semi-circular support structures. The semi-circular support structures are similar and connected to each other by a fabric web. The fabric web is fixed through parallel opening lines to each of the support structures by: one or more first and second double male anchor type member with pins, extending on both sides of the double male anchoring members keeping between the pins the same equidistant distances to each other that keep the openings of the semi-circular support structures; and one or more first and second female anchoring members with equidistant openings keeping between the openings the same equidistant distances to each other that keep the openings of the semi-circular support structures.

24 Claims, 18 Drawing Sheets

(56) References Cited

U.S. PATENT DOCUMENTS 3,036,802 A 5/1962 Kitchell
3,112,715 A * 12/1963 Callahan ..... B65D 19/0048 108/51.3
3,113,532 A * 12/1963 White ..... B65D 19/0085 108/51.3
7,913,630 B2 * 3/2011 Creighton ..... B65D 19/0026 108/55.1
8,468,955 B2 * 6/2013 Durco ..... B65D 19/0012 108/57.17
2011/0030588 A1 * 2/2011 Baechle ..... B65D 19/0026 108/51.3

* cited by examiner

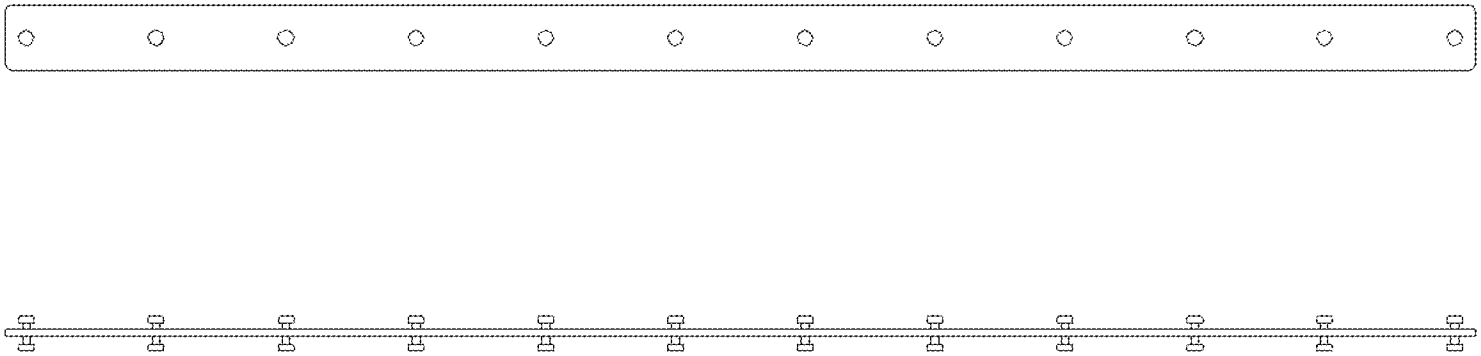
FIGURE 4
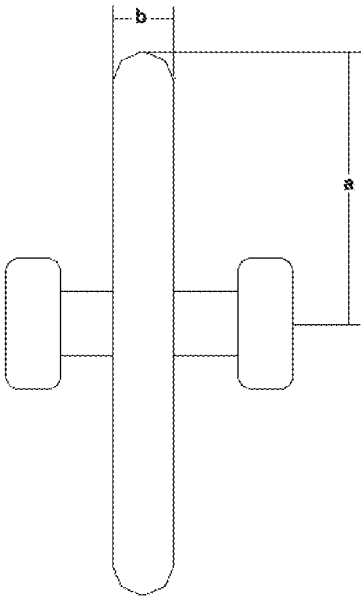

ENGAGING SYSTEM FROM CROSS STACKING

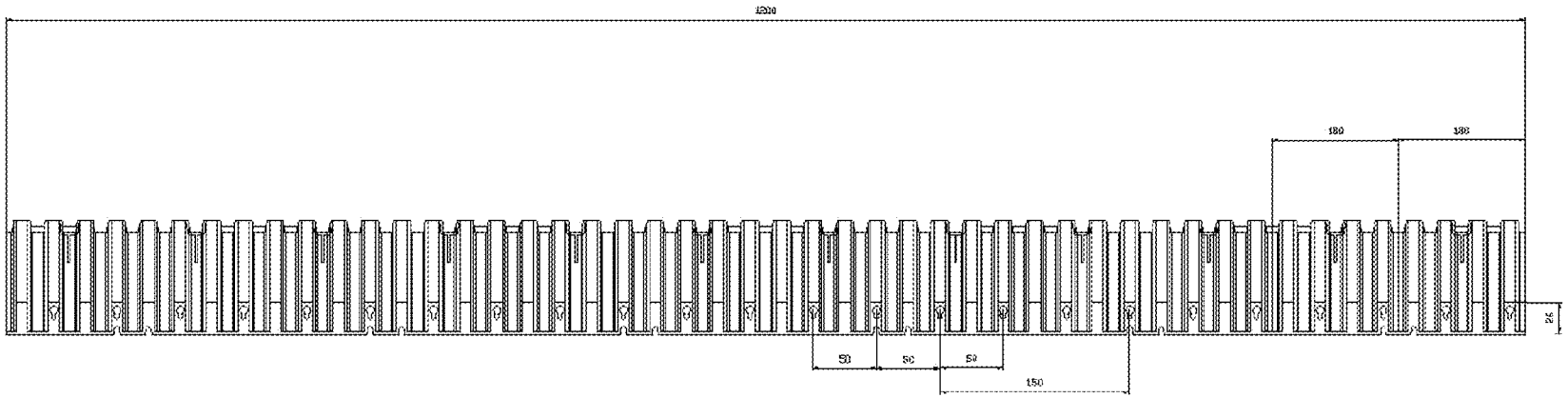
FIGURE 11
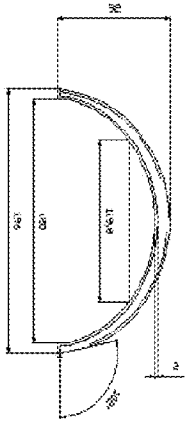
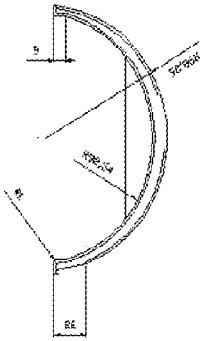

ECOLOGICAL PALLET

FIELD OF THE INVENTION

The present invention relates to a pallet structure made of organic materials other than wood, which is used to hold packages, boxes, articles, products, palletized loads, bundles, and the like, and its manufacturing method.

Such a structure by not using wood in its construction helps the environment by avoiding indiscriminate felling of trees for these types of products, in addition to the additional property of not being pest vector as wood.

BACKGROUND OF THE INVENTION

The wooden pallet manufacturing industry uses wood as the main component of manufacture and greatly contributes to increasing deforestation afflicting the world.

In Argentina, for example, most of the native forests in the last 100 years have been lost, generating an environmental damage very difficult to recover.

It would be critical to give wood a highest purpose than making pallets that produce a greater added value (such as furniture, wood pulp, etc.).

The annual consumption of pallets for a country like Argentina is estimated in 2 to 2.5 pallets per capita, n developed countries this rate is twice or more.

It is estimated that of a pine or *eucalyptus* of 20 years old 7 pallets can be manufactured, as the wood waste in this production is great.

It is estimated that one hectare has an average of 1150 planted trees.

Consequently, in a country like Argentina with a population estimated at 44 million inhabitants, this implies a consumption of 88 million pallets per year.

Considering that for every tree seven pallets are manufactured, we will have 12,571,429 trees a year for the manufacture of pallets.

Considering a maximum of 1150 trees per hectare we will have a value of 10,931 hectares of forest per year consumed which are processed on pallets.

It is to be noted that in order to have trees grown and available every year, we need to have 20 times this area of growing forests, i.e., 218,633.5 hectares of forest are used for manufacturing pallets, which are mostly destroyed during the first year of use.

This area corresponds to 20% of total cultivated forests in Argentina (Source FEDERAL INVESTMENT COUNCIL). The same calculations can be made for other countries.

Therefore with a best economic use of wood, this important area of fertile land would be available for more productive purposes or to restore the necessary native forests.

Furthermore, the pharmaceutical industries are based on GMP standards which do not allow the reuse of a wooden pallet for not being sanitizable, which implies destruction of the same. In other industries as slaughterhouses, dairy, ice cream and food industries in general similar standards due to the sensitive material they produce should be adopted.

According to the above discussion, a way to contribute to the regeneration of forests as an ecology tool is to limit the use of wood to what is strictly necessary.

The types of pallets of the prior art considered herein are those disclosed by the following patents:

U.S. Pat. No. 2,774,490 A refers to a shipping unit comprising in combination a pile composed of courses of filled bags of oblong shape each course containing at least one bag disposed longitudinally along one side of said pile and another bag disposed between the inner side thereof and the opposite side of the pile and adjacent courses having a longitudinally disposed bag on opposite sides of said pile and a lifting skid located under the bottom course of the pile, said skid consisting essentially of a pair of parallel hollow tube members extending longitudinally under said pile and located centrally under said longitudinally disposed packages and having walls sufficiently rigid to support at least 25% of the weight of the pile and an internal size sufficient to receive the forks of a lift truck and a web connecting said hollow tubular members and having a length such as to support the central area of said bottom course when they are lifted. The web is connected to the members by an adhesive.

U.S. Pat. No. 3,036,802 A refers to a pallet to support a load comprising a sheet member having a plurality of pair of slots therein, a plurality of semi-cylindrical hollow members with a fork engaging channel, the semi-cylindrical members are fixed by strapping means through the slots of the sheet member.

U.S. Pat. No. 3,112,715 A refers to a non renewable foldable pallet adapted to occupy less space comprising a pair of substantially parallel open channels defined by rigid semi-cylindrical sections constructed of half-sections of cemented fiberboard tubes having a wall thickness of 0.1 to 0.5 inches and a horizontally oriented flexible supporting web adhesively attached to the convex outer surface of the semi-cylindrical channels; said semi-cylindrical channels can receive the forks of a lift truck to support loads on the web.

U.S. Pat. No. 5,067,418 refers to a recyclable paper pallet, having tubes with slots where elongated runners engage, being the same totally rigid to support loads.

U.S. Pat. No. 5,890,437 refers to a collapsible pallet with rectangular support blocks and reinforcing slats.

U.S. Pat. No. 6,533,121 B1 refers to a bag pallet structure for bulk materials.

U.S. Pat. No. 7,516,706 B2 refers to a knockdown pallet structure comprising semi-circular members fixed to a web, that can receive the forks of a lift truck to transport a load, with reinforcing slats extending through the pockets of the web, so as to stretch the fabric for transportation of loads.

U.S. Pat. No. 7,913,630 B2 refers to a combination knockdown pallet structure as the preceding reference and a bag article container.

The US 20100050910 A1 publication refers to a pallet wherein the fabric is sewed to the two support elements.

SUMMARY OF THE INVENTION

The pallet described herein comprises the following members:

1) Fabric web that can be of polypropylene woven raffia fabric, with 6 lines of successive openings made at equidistant intervals.
2) Two semi-circular support structures, which are elongated arch-shaped structures, corresponding to half section injection molded supports, with a succession of continuous ribs, made of polypropylene or high density polyethylene. The same have specially shaped openings on one of their sides and hollow cylindrical structures on the longitudinal ends of the other side; the support structures can be comprised by more than one component that can be attached to form a single support structure. The specially shaped openings have on the upper portion a larger diameter, on the lower portion a smaller diameter, and on the middle portion a passage necking allowing the passage of the pin heads of one or more double male anchoring members.

3) Polypropylene or high density polyethylene injected double male anchoring members, for example, that is a flat member having pins with heads and a body out of the plane towards both sides of the member. The ecological pallet of the invention can use a single double male anchoring member or several double male anchoring members in the assembly.

4) Polypropylene or high density polyethylene injected female anchoring member, for example, is a flat member with specially shaped holes. These specially shaped openings have on the upper portion a larger diameter, on the lower portion a smaller diameter, and on the middle portion a passage necking. The larger diameter allows the passage of the pin heads of the double male anchoring member, and the smaller diameter allows housing the pin bodies, going the head through the head by the upper portion and taking the pin to the lower portion resistance to the passage in the aforementioned necking is provided, that when beaten allows housing of the body of the pins and generates resistance to move to the upper portion and release. The ecological pallet of the invention can use only one female anchoring member or several female anchoring members on the assembly.

5) The cylindrical pins for attachment to another pallet are cylindrical pins of a larger diameter, a smaller diameter and a small bulge on the end of the smaller diameter. The larger serves as a guide inside the cylindrical housing of the pin on the ends of the semi-circular support structures. The smaller diameter retractably protrudes away from the platform to place a pin on each corner of the same that matches with the 4 openings on the corners of another wooden or solid plastic pallet, to fix the platform on the same. The bulge on the end of the lower diameter portion is to prevent the retraction of pin limiting its stroke.

Characteristics of the Ecological Pallet:

1) It is a transport platform for sacks and bags, 100% made in plastic.

2) Such platforms can only be moved or loaded using lift trucks with forks to engage pallets.

3) Due to its constituent materials, there is no need of sanitization treatments to be used in exports and meet the custom health standards NIMF 15.

4) It is assembled with 4 types of different elements, semi-circular support structures made of molded plastic pieces, a fabric web as a raffia tarpaulin and double male and female anchoring members.

5) The functionality of the platform is based on the stiffness of the forks of the lift trucks, the extremely high tensile strength of the raffia fabric web and the resistance of the semi-circular support structures made of molded plastic pieces with continuous ribs to increase the stiffness.

6) When a platform with its load must be moved by an forklift, forks are placed inside the semicircular support structures in parallel by one of its ends to fully penetrate and upon lifting the fork, the semi-circular support structures are vertically pushed by the forks and transmit the force to the fabric web, and being a perfectly assembled assembly, it is able to support very well the loads and movements of the same.

7) When it is moved and is stacked, either in a warehouse, the floor or on another wooden or plastic pallet, the semi-circular support structures perfectly support the weight of the load.

8) All the constituent parts are recoverable and recyclable, and the platform is reusable and repairable.

9) The assembly and disassembly is done manually without the use of tools or devices.

10) The semicircular support structures have a special shape designed to support the weight of the loads to be transported.

11) The semicircular support structures are a succession of sections constructed of half-sections attached and aligned so as to generate a self-supporting and load resistant structure.

12) The semi-circular support structures have inner horizontal ribs that cross and link the arcs and reinforce the load resistance of the structure.

13) Said inner horizontal ribs jointly form a virtual plane to allow a better contact and support of the lift fork forks when the platform is raised by this machine, supporting the vertical push and transmitting the same to the semi-circular support structures and providing load stability.

14) The semi-circular support structures have specially shaped openings to allow anchoring of the double male anchoring member and for example the raffia fabric web.

15) These specially shaped openings have on the upper portion a larger diameter and on the lower portion a smaller diameter, and on the middle portion a passage necking. The larger diameter allows the passage of the pin heads of the anchoring member, and the smaller diameter allows housing the pin bodies, so that going the head through the upper portion and taking the pin to the lower portion we find a passage resistance at said necking, that when beaten allows housing of the body of the pins and generates a resistance to move to the upper portion and release.

16) The semi-circular support structures have modified and reinforced longitudinal ends which help to better withstand the bumps and scratches when entering the metal forks of the forklifts.

17) The semi-circular support structures have outer horizontal ribs that connect the arcs to certain zones and to the floor supports, certain vertical slits on both sides of the support, such that when supports are manufactured in the molding machine and are orthogonally stacked on each other in layers aligned, these horizontal ribs match positionally to the aforementioned vertical slits, locking the parts supported upon one another, giving stability to the pile of parts.

18) The semi-circular support structures have on one side of each of their ends a cylindrical housing wherein a plastic pin is inserted that is moveable orthogonally to the support surface, protruding from the support and allowing to fix the platform on a wooden or plastic pallet prepared to receive the same and retracting when it is supported on a smooth surface, warehouse floor or load deck of a truck or container.

19) The double male anchoring member interacts with the semi-circular support structures and with the female anchoring member through the pins that protrude from its body at regular intervals, having at the beginning a smaller diameter (body) and at the end a larger diameter (head).

20) The female anchoring member has specially shaped openings to anchor the pins of the double male anchoring member.

21) These specially shaped openings have on the upper portion a larger diameter and on the lower portion a smaller diameter, and on the middle portion a passage necking. The larger diameter allows the passage of the pin heads of the anchoring member, and the smaller diameter allows housing the pin bodies, so that going the head through the upper portion and taking the pin to the lower portion we find a passage resistance at said necking, that when beaten allows housing of the body of the pins and generates a resistance to move to the upper portion and release.

22) The web can be preferably made of raffia and does not need any sewing work, saving processes and avoids the distortion in the proper alignment of the semi-circular support structures.

23) The attachment of the fabric web to the semi-circular support structures is made with manually assembled mechanical locks.

24) The fabric web preferably made of raffia has a succession of openings at predetermined places to allow the passage of the assembly pins of the double male anchoring member and the connecting pins of the platform on a pallet.

25) The assembly system of semi-circular support structures, double male anchoring members, female anchoring member and a web preferably made of raffia, results in a safe, efficient, lightweight and economical platform.

26) The platform can be shipped disassembled and assembled by the user in an economic and simple way, quickly and manually without use of tools or devices. In the same way, trained personnel may repair the damaged platforms.

27) Shipping disassembled platforms results in significant savings of freight, space in warehouses and optimizes the use of labor.

BRIEF DESCRIPTION OF THE DRAWINGS

FIG. 4 shows a side view and an upper view (or lower view) as well as a front view of the double male anchoring member.

FIG. 11 shows a side view of a support structure from the side of the openings with two front views with dimensions in millimeters and angles in degrees by way of example.

DETAILED DESCRIPTION OF THE INVENTION

Figure 1:
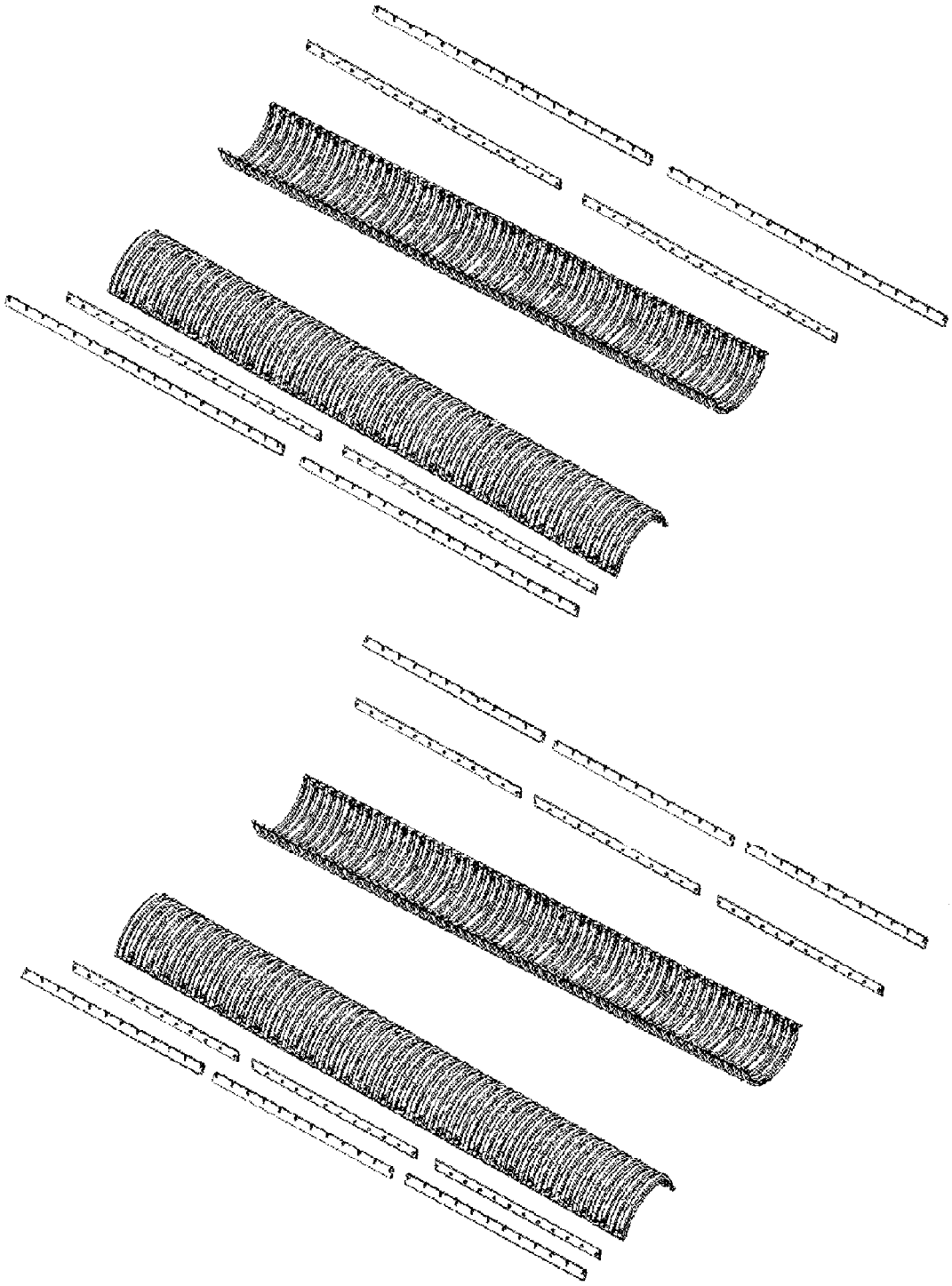
FIG. 1 shows the support structures of the ecological pallet of the invention from above and from below together with the first and second double male anchoring members and first and second female anchoring members at the sides of the semi-circular support structures. It is noted that the anchoring members for every type of member can be more than one, the upper view shows 2 double male anchoring members and 2 female anchoring members for each support structure of the ecological pallet and the lower view shows 3 double male anchoring members and 3 female anchoring members for each support structure of the ecological pallet.
Figure 2:
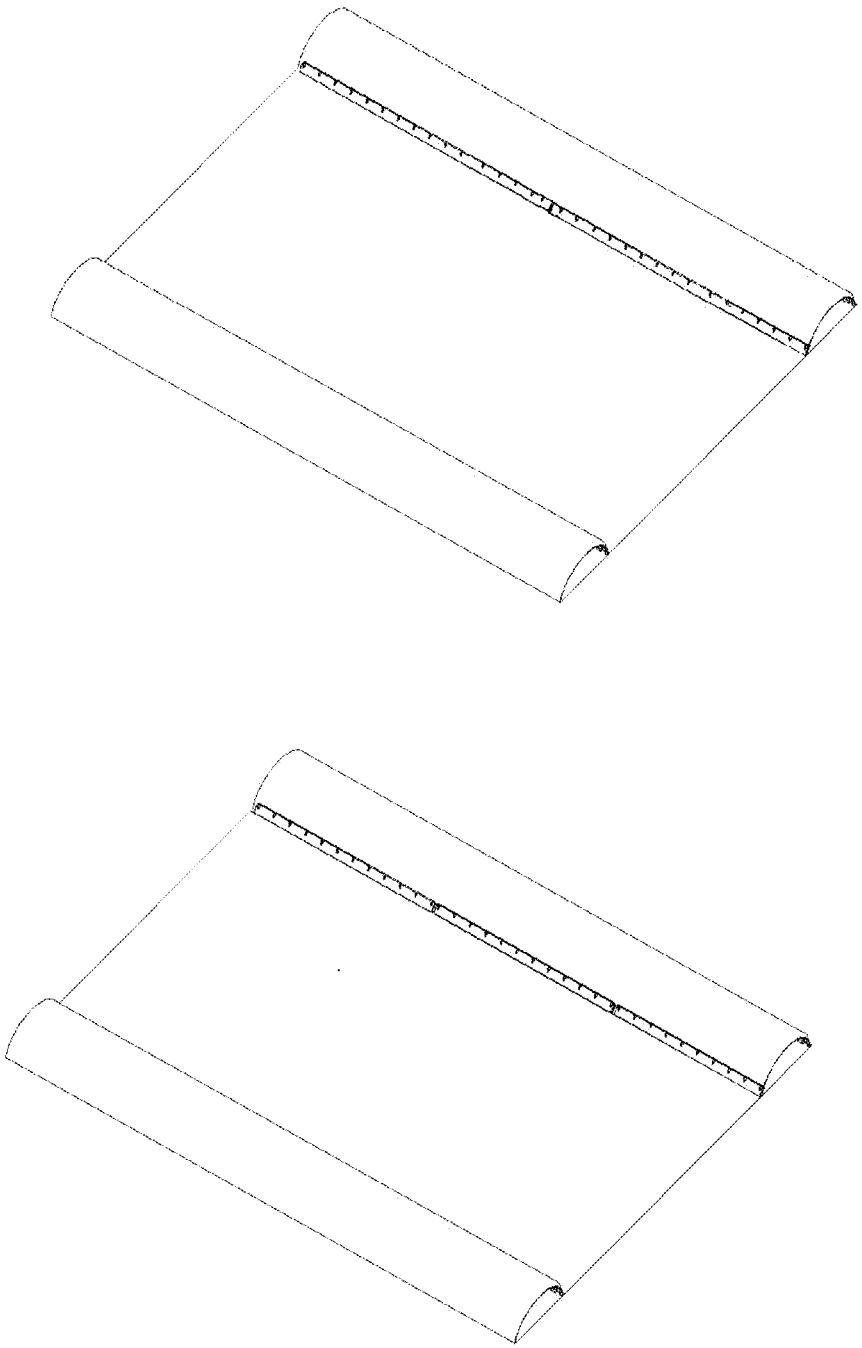
FIG. 2 shows two alternatives of the assembled ecological pallet with the components of FIG. 1, wherein the female anchoring members are locked on the pins of the double male anchoring members. Each case uses sets of two and three anchoring members for each assembled ecological pallet.
Figure 3:
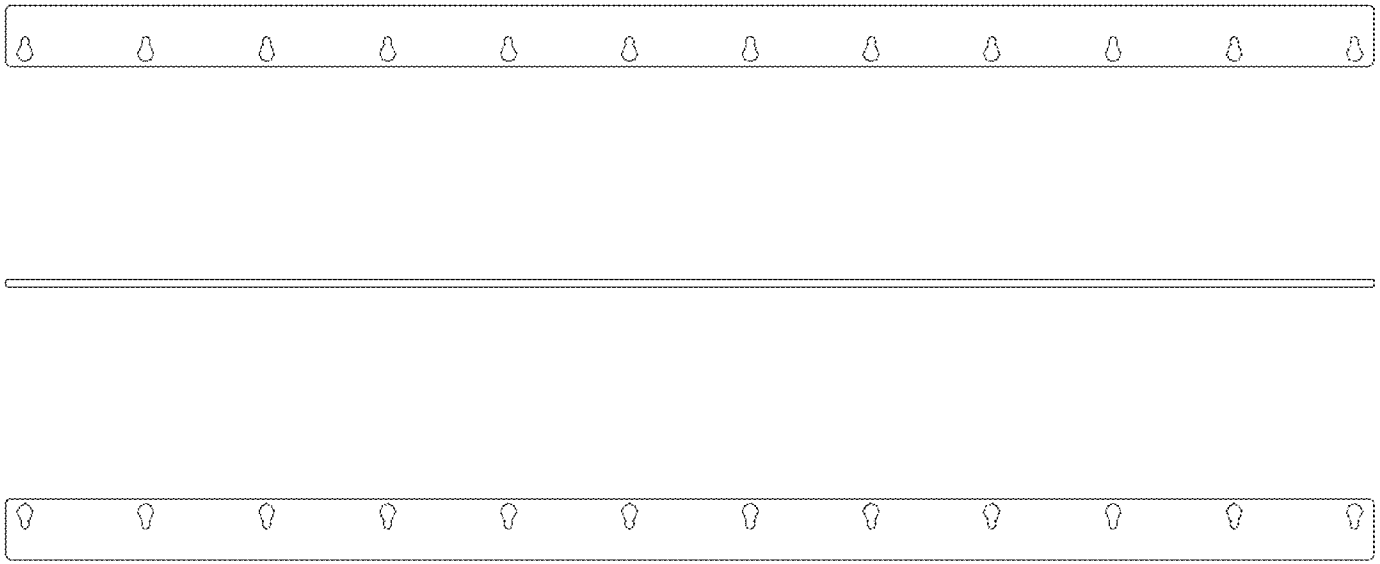
FIG. 3 shows views from the left, from the right or above (which matches with the lower view) of a female anchoring member.
Figure 5:
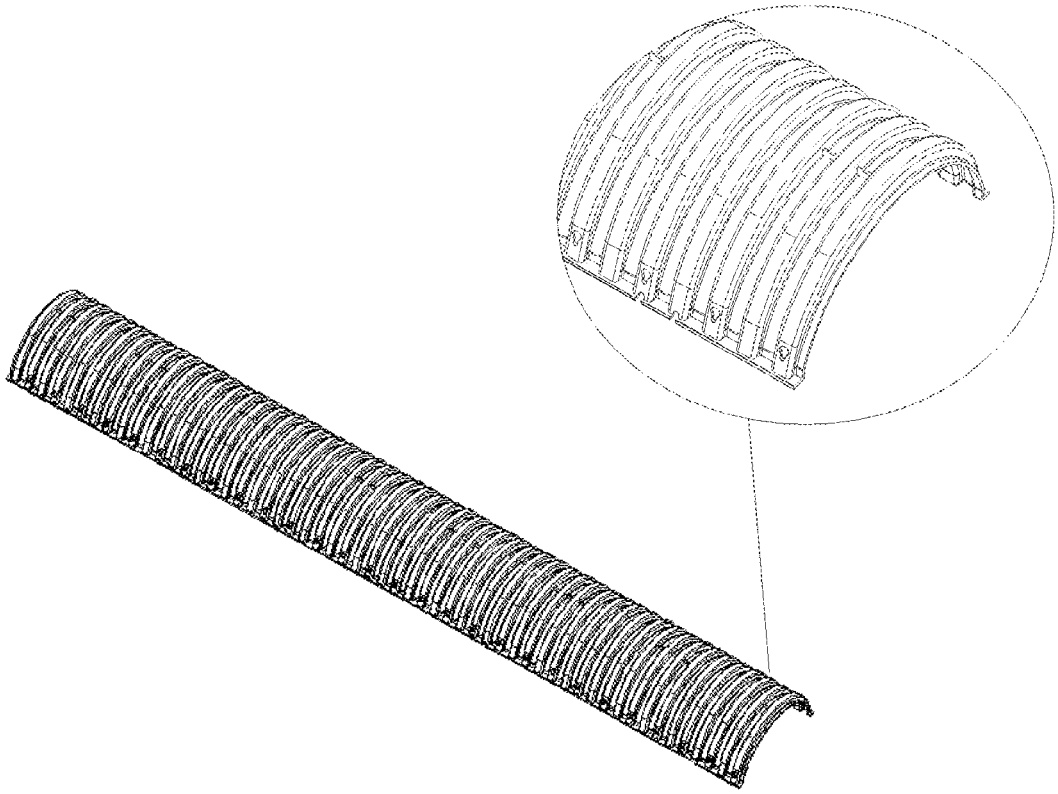
FIG. 5 shows a perspective view from the left side of a support structure with an extension of its end.

The ecological pallet of the invention as can be observed in the alternatives of FIG. 2, two semi-circular support structures, which are elongated arch-shaped structures, with openings located at equidistant distances on one of the sides of each of said semi-circular support structures, wherein said semi-circular support structures are equal and are connected to each other by a fabric web characterized in that the fabric web is fixed through parallel opening lines to each of the support structures by:

(i) one or more first and second double male anchor type member with pins, which have a head and body and extending on both sides of said double male anchoring members keeping between the pins the same equidistant distances to each other that keep the openings of the semi-circular support structures, and (ii) one or more first and second female anchoring members with equidistant openings keeping between the holes of the same equidistant distances to each other that keep the openings of the semi-circular support structures, wherein the openings of the one or more first and second female anchoring members and the openings of each one of the two semi-circular support structures are locked by the pins located at each side of the one or more first and second double male anchoring members respectively; as it can be seen in the upper view of FIG. 1, each illustrated support structure comprises two double male anchoring members and two female anchoring members (corresponding to the first or second anchoring members if used in one semi-circular support structure or the other semi-circular support structure), in the lower view of FIG. 1 each illustrated support structure comprises three double male anchoring members and three female anchoring members (corresponding to the first or second anchoring members if used in one semi-circular support structure or the other semi-circular support structure).

Each of the support structures and anchoring members of FIG. 1 result in the assembled ecological pallets of FIG. 2 that use in the upper view two first double male anchoring members and two first female anchoring members for one of the semi-circular support structures and two second double male anchoring members and two second female anchoring members for the other semi-circular support structure. In the same way the lower view of FIG. 2 shows an ecological pallet as the previously described using three first double male anchoring members and three first female anchoring members, for the other semi-circular support structure uses three first double male anchoring members and three second female anchoring members.

The ecological pallet according to this disclosure could also have a single first and a single second double male anchoring member and a single first and a single second female anchoring member for the two semi-circular support structures comprising the same.

According to the preceding paragraph in the ecological pallet of this disclosure the one or more first anchoring members fix the fabric web to a semi-circular support structure and one or more second anchoring member fix the fabric web to the other semi-circular support structure.

Figure 13:
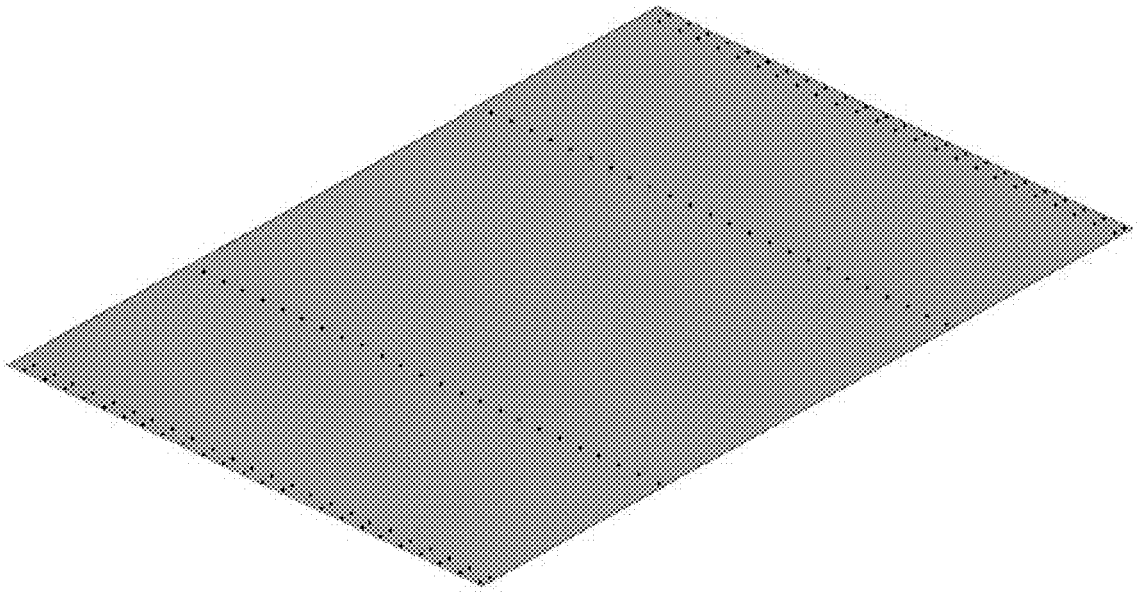
FIG. 13 shows the fabric web with the 6 parallel opening lines wherein each opening is equidistant to the following on each of the lines keeping the same equal distances to each other that keep the openings on one of the sides of the semi-circular support structures.

In the ecological pallet the fabric web comprises 6 parallel opening lines wherein each opening is equidistant to the following within each of the lines so as to keep the same equidistant distances to each other that keep the openings on one of the sides of the semi-circular support structures; said lines of openings can be seen in FIG. 13. The total number of openings of each line of openings of the fabric web is equal to the number of openings of the semi-circular support structures. Said number of openings is also equal to the total number of pins that comprise all the double male anchoring members used in the assembly of the ecological pallet and also is equal to all the openings that comprise all the female anchoring members used in the assembly of the ecological pallet.

The spacing between the centers of the openings between the first and second line of openings on one end of the fabric web is equal to the spacing between the centers of the openings between the fifth and sixth line of openings on the other end of the fabric web and is equal to the width of the double male anchoring member/s added to the thickness of said anchoring member/s when the pins are centered on the sides of said double male anchoring member.

In the ecological pallet the spacing between the centers of the openings between the first and second line of openings on one end of the fabric web is equal to the spacing between the centers of the openings between the fifth and sixth line of openings on the other end of the fabric web and is equal to the width of the double male anchoring member/s added to the thickness of said anchoring member/s when the pins are centered on the sides of said double male anchoring member; that is to say it is equal to twice the distance "a" added to the distance "b" of front view of the double male anchoring member of FIG. 4.

In the ecological pallet of this disclosure, the spacing between the opening centers between the first line of openings and the closest end of the fabric web is equal to the spacing between the opening centers between the sixth line of openings and the other end of the fabric web and is equal to half the width of the double male anchoring member, corresponding to the distance "a" of the front view of the double male anchoring member of FIG. 4.

In the ecological pallet of this disclosure, the spacing between the opening centers between the second line of openings and the third line of openings of the fabric web is equal to the spacing between the fourth line of openings and the fifth line of openings of the fabric web and is equal to the outer diameter of the semi-circular support structures added to the length of the outer arch of semi-circular support structures.

Figure 14:
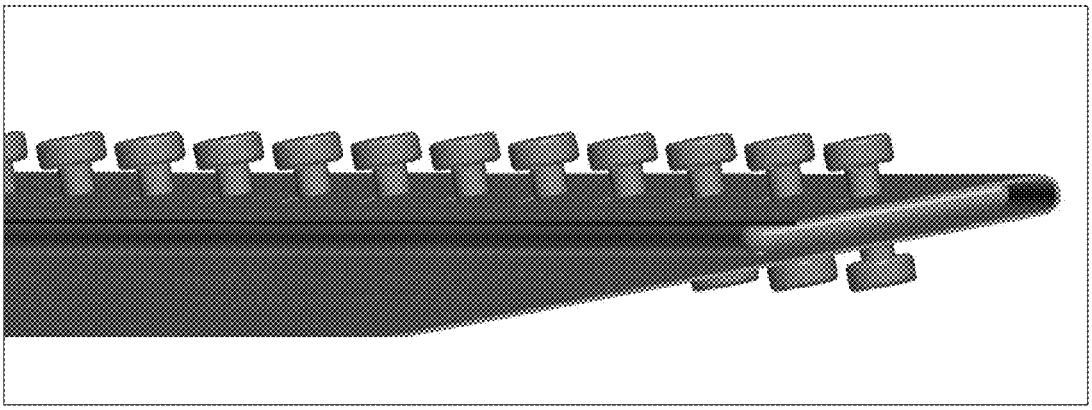
FIG. 14 shows an end of the fabric web wrapping the double male anchoring member.

In the ecological pallet the first and second line of openings on a first end of the fabric web is traversed by the pins at both sides of the one or more double male first anchoring member respectively being said first double male anchoring member/s wrapped by said first end of the fabric web, and in the same way, the fifth and sixth line of openings of the other end of the fabric web is traversed by the pins at both sides of one or more second double male anchoring member respectively being said second double male anchoring member/s wrapped by said second end of the fabric web; FIG. 14 shows an example of this for an end of the fabric web.

Figure 15:
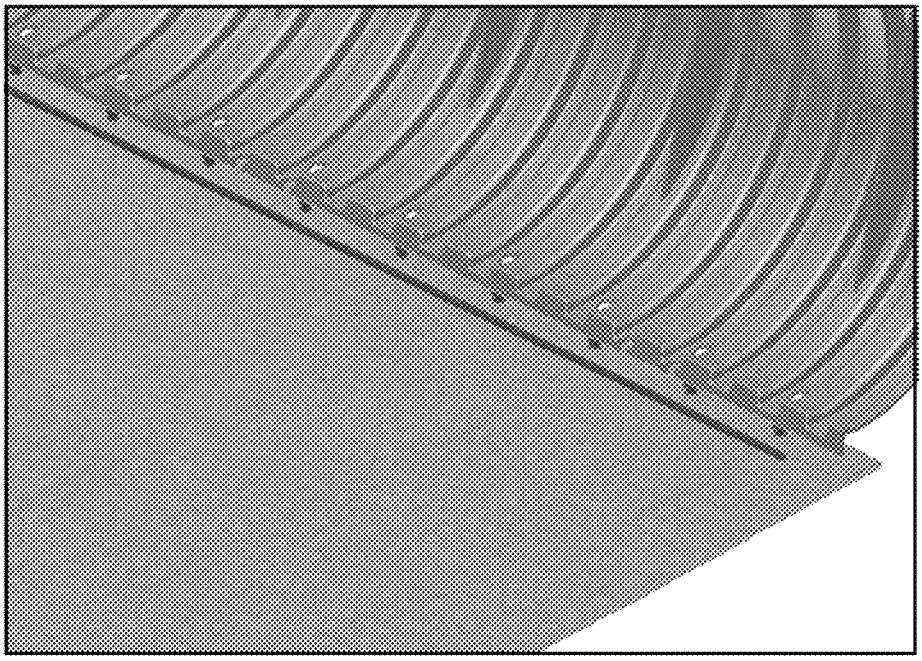
FIG. 15 shows how the fabric web wrapping the double male anchoring member is located in front of the openings of the support structure in the upper view and how it is engaged in the lower view.
Figure 15:
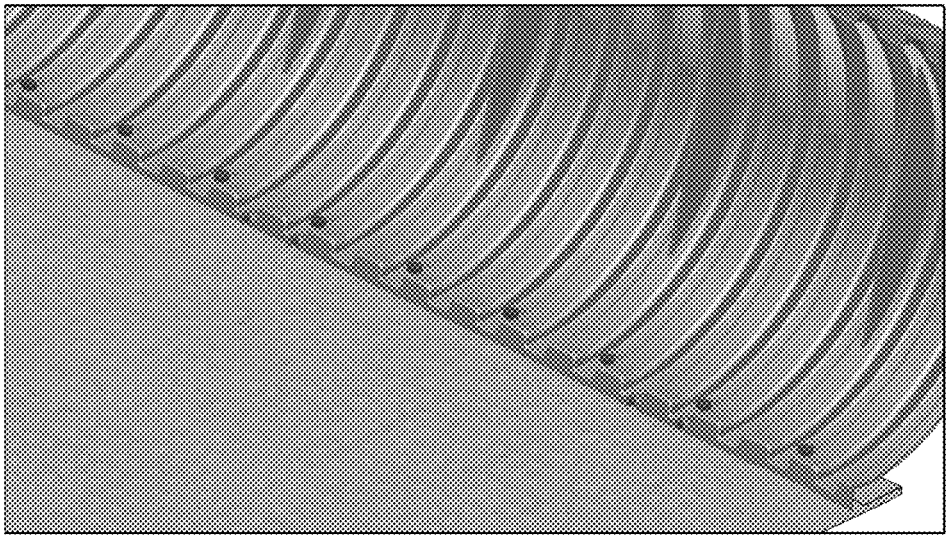

In the ecological pallet, the pins projecting through the first line of outermost openings of an end of the fabric web engage on the equidistant openings of one of the two semi-circular support structures and the pins projecting through the sixth line of outermost openings of the other end of the fabric web engage on the equidistant openings of the other semi-circular support structure. FIG. 15 shows this above described engaging process.

FIGS. 8, 9, 10 and 11 show examples of semi circular support structures which are elongated arch-shaped structures, with openings located at equidistant distances on one of the sides. Considering the arch shape of the same, they can be half-shaped (with one center arch) or carpanel shaped (with three center arch). The shape and size of the arch define the spacing between the second and third lines of openings of the fabric web that is equal to the spacing of the fourth and fifth lines of openings of said fabric web.

In the ecological pallet, the spacing between the opening centers between the second line of openings and the third line of openings of the fabric web is equal to the spacing between the fourth line of openings and the fifth line of openings of the fabric web and is equal to the inner diameter of the semi-circular support structures added to the length of the outer arch of the semi-circular support structures when the arch corresponds to a semi circumference; in this case the arch length would be $(\pi*d)/2$, where d is equal to the outer diameter of the semi-circular support structures.

The spacing between the third and fourth line of openings of the fabric web depends on the separation between the forks of the forklift that will carry the loads on the ecological pallet.

In the ecological pallet of this disclosure, the pins projecting through the first line of outermost openings of an end of the fabric web engage on the equidistant openings of the first semi-circular support structure and the pins projecting through the sixth line of outermost openings of the other end of the fabric web engage on the equidistant openings of the second semi-circular support structure; this can be observed in the lower view of FIG. 15.

Figure 16:
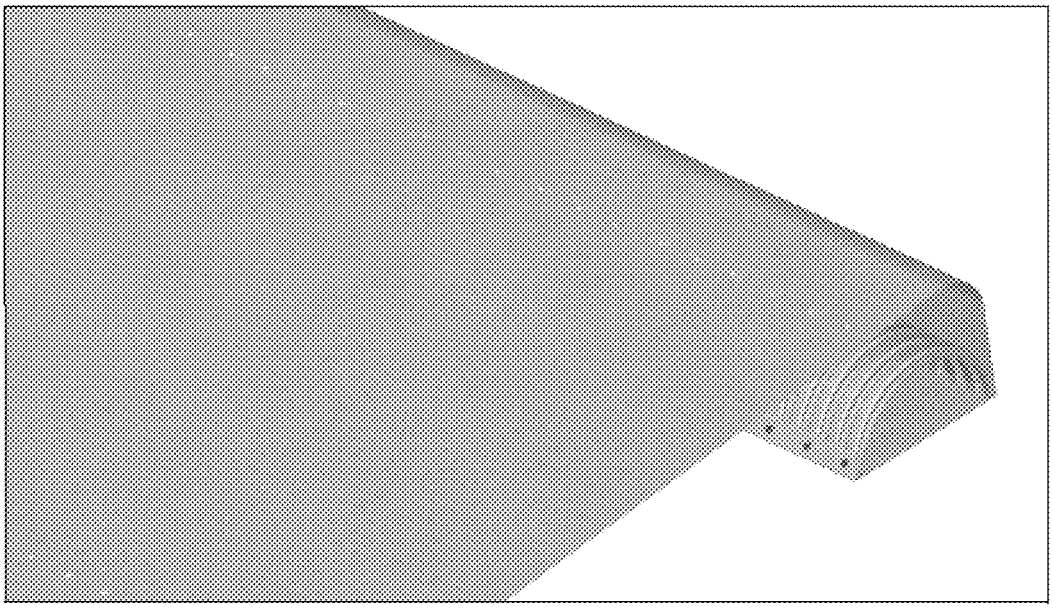
FIG. 16 shows how the fabric web wraps the semi-circular support structure.

In the ecological pallet according to this disclosure, the first end of the fabric web wraps the first semi-circular support structure, that is an arc-shaped elongated structure, going first underneath the base of the arch and then above the arch engaging the third line of equidistant openings of the fabric web on the projecting pins of the one or more double male first anchoring member at the side that does not engage to the semi-circular support structure and in the same way, the second end of the fabric web wraps the second semi-circular support structure, that is an arc-shaped elongated structure, going first underneath the base of the arch and then above the arch engaging the fourth line of openings of the fabric web on the projecting pins of one or more second double male anchoring member at the side that does not engages to the other semi-circular support structure; a way to embody this can be seen in FIG. 16.

Figure 7:
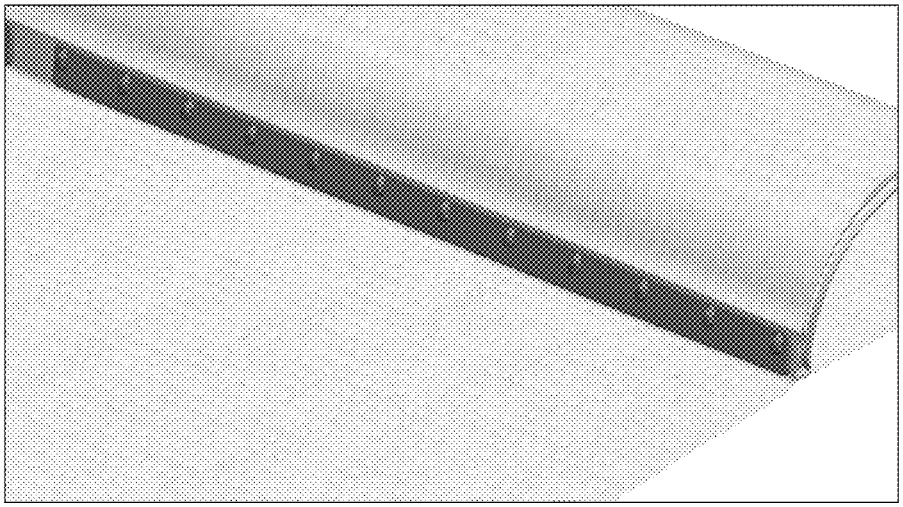
FIG. 7 shows how a support structure with the web and the anchoring members is disposed.

Then the one or more first female anchoring members engage to the pins projecting through the third line of openings of the fabric web and one or more second female anchoring member engage to the pins projecting through fourth line of openings of the fabric web, as illustrated in FIG. 7.

Raffia is preferred as the material for the fabric web.

Also preferably the anchoring members as well as the support structures are made of a plastic material, specially polypropylene or high density polyethylene.

In the ecological pallet according to this disclosure, the equidistant openings of the two semi-circular support structures as the one or more first and second female anchoring members have a special shape having in the upper portion a larger diameter that allows the passage of the pin heads of the double male anchoring members and in the lower portion a smaller diameter that allows the passage of the body of said pins, and on the middle portion a passage necking so that going the head through the upper portion and taking the pin to the lower portion resistance to the passage in the aforementioned necking is provided, that when beaten allows housing of the body of the pins and generates a resistance to move to the upper portion and release.

Figure 8:
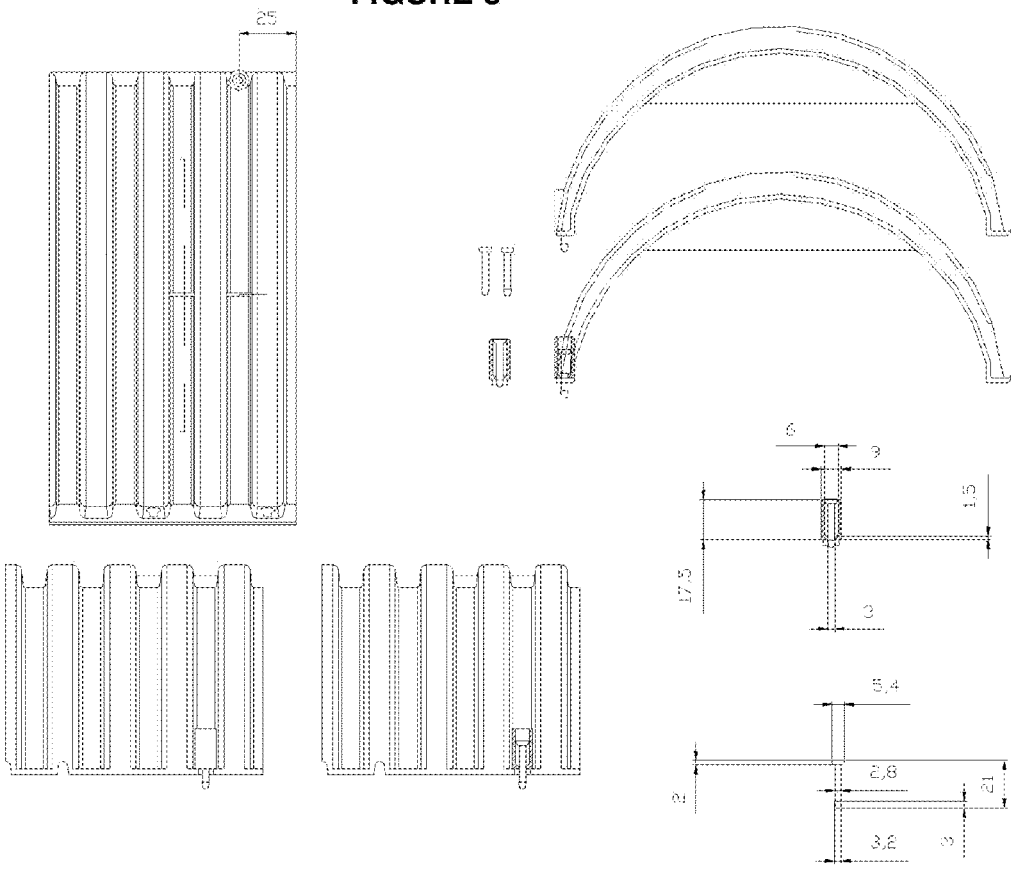
FIG. 8 shows in detail an end of the support structure with a cylindrical housing wherein a plastic pin is orthogonally moveable in relation with the support surface, protruding from the support and allowing fixing the platform on a wooden or plastic pallet prepared to receive the same and retracting when lying on a smooth surface, warehouse floor or load deck of a truck or container. Illustrative dimensions of the plastic pins and cylindrical housing are expressed in millimeters; and the lower portion of said figure shows the locking and cross stacking system of several support structures allowing saving space during manufacturing.
Figure 8:
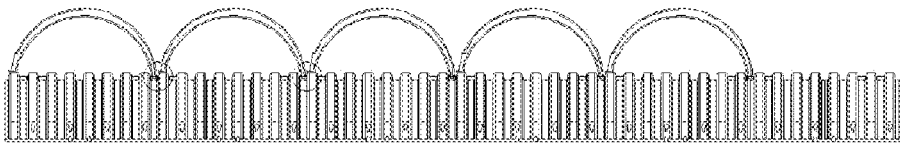
Figure 9:
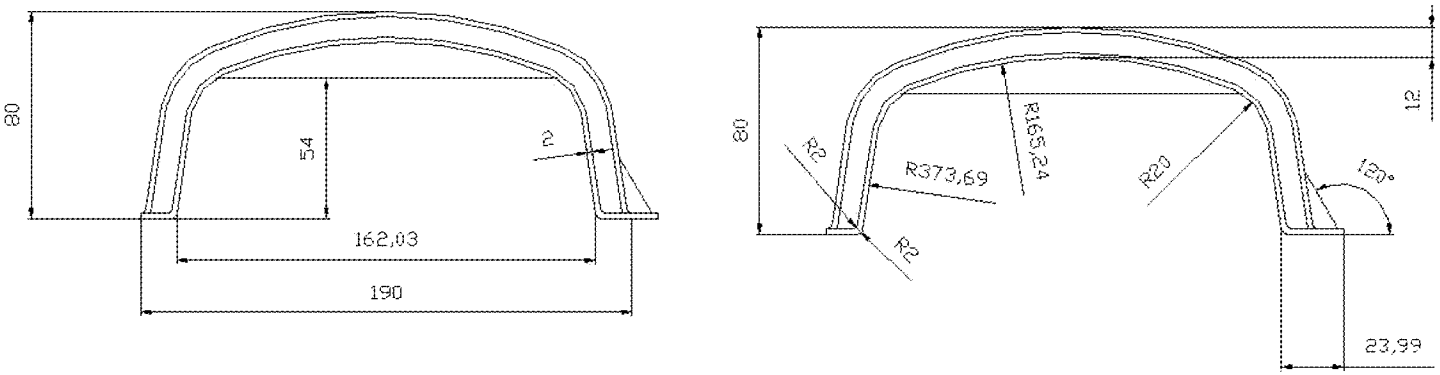
FIG. 9 shows two types of design of support structures with its dimensions in millimeters and angles in degrees by way of example.

The semi-circular support structures also have cylindrical housings on their ends at the side opposite to the openings located at equal distances, that contain cylindrical pins allowing attachment on another pallet; said cylindrical housings as well as the pins can be seen in FIG. 8.

Cylindrical pins have a larger diameter, a smaller diameter and a small bulge on the end of the smaller diameter, the larger diameter is used as a guide inside the cylindrical housing on the ends of the semi-circular support structures, the smaller diameter retractably protrudes from the platform to leave a pin on each corner of the same that matches to 4 openings on the corners of another wooden or solid plastic pallet, to fix the platform on the same, the bulge on the end of smaller diameter portion is to avoid retraction of the pin limiting the stroke of the same.

In a preferred embodiment of the invention, the semi-circular support structures have a succession of parallel continuous ribs to improve their strength, said ribs copy the arch shape of the support structure. Said ribs are better seen in the upper view of FIG. 10.

Figure 6:
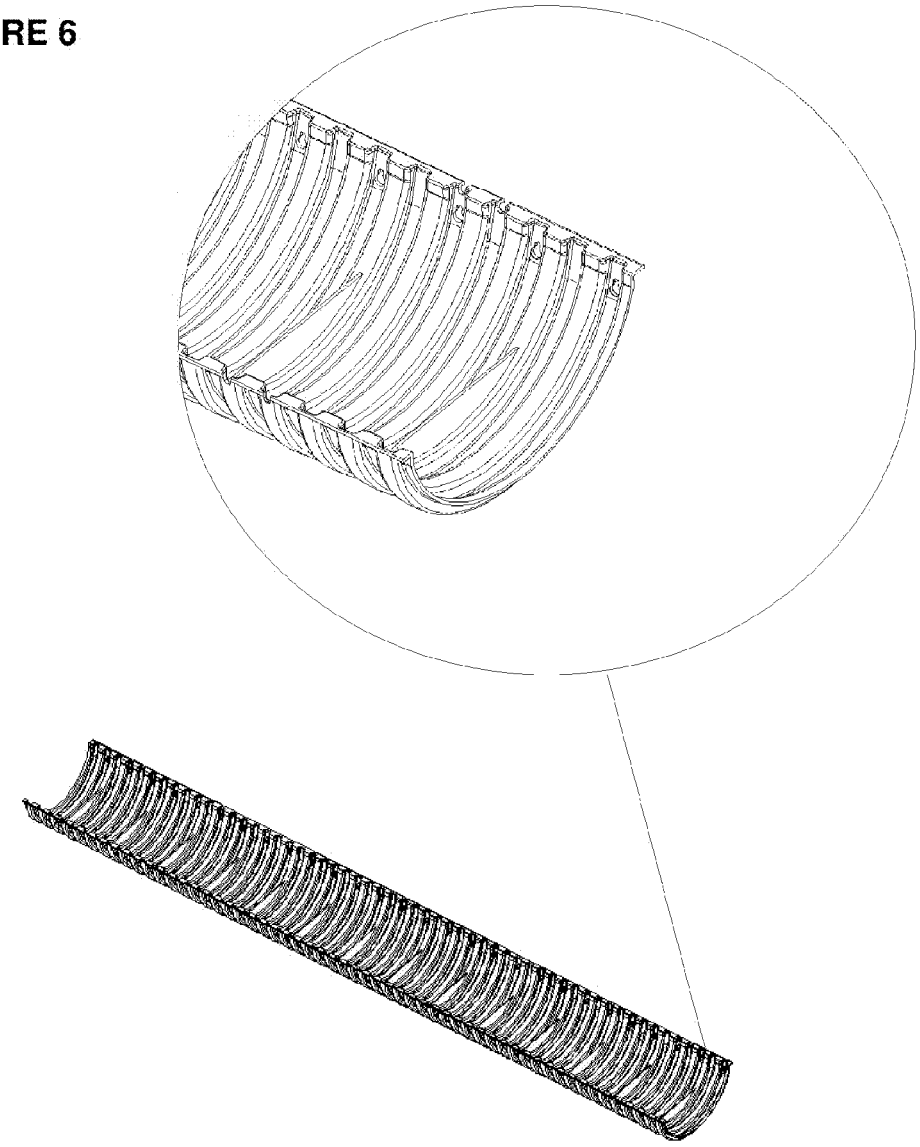
FIG. 6 shows a perspective view of the support structure dada inverted with an extension of its end.

In the same way, the two semi-circular support structures have inner horizontal ribs that cross and link the inner upper portion of the arcs and reinforce the load resistance of the structure, said ribs can be observed in the exploded view of FIG. 6.

Figure 10:
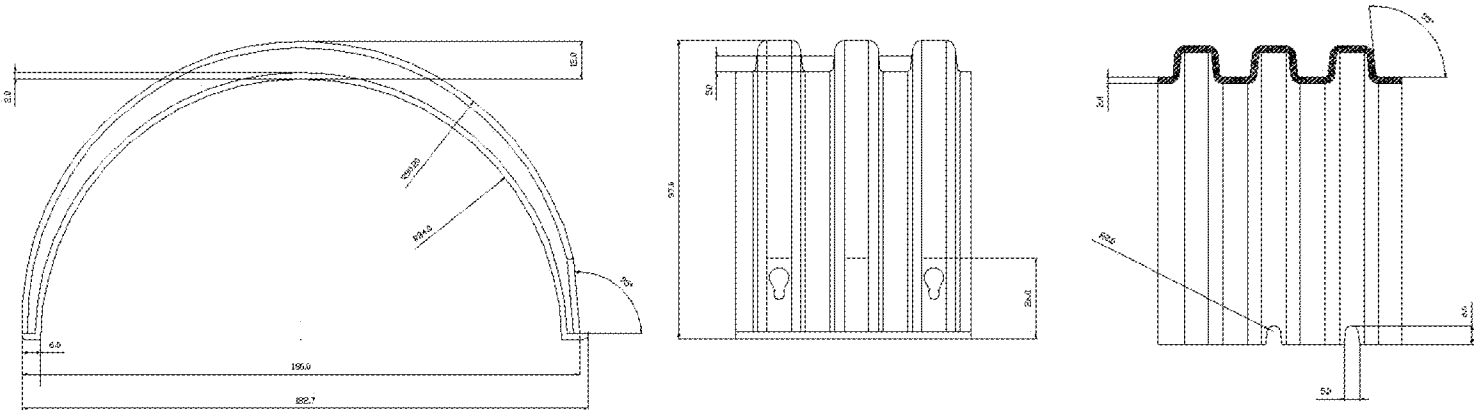
FIG. 10 shows a front and side section view of the support structure with the reinforcing ribs; wherein by way of example dimensions in millimeters and angles in grades are shown.
Figure 12:
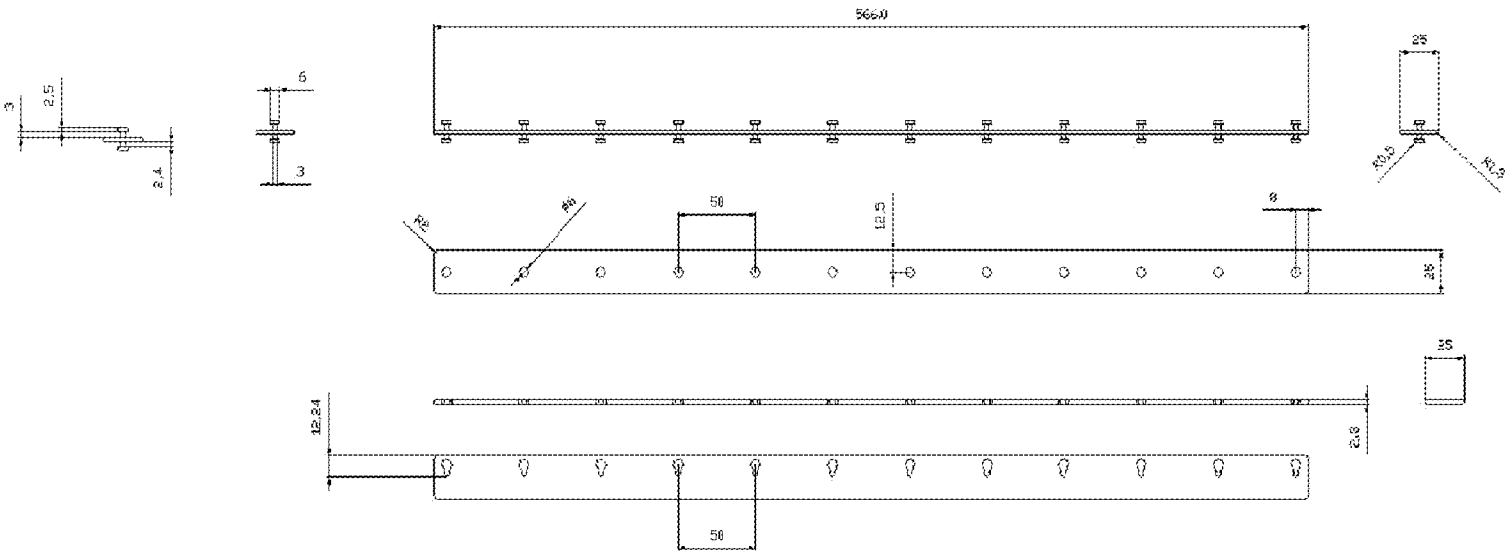
FIG. 12 shows an upper view and a side view of the double male anchoring member and the female anchoring member with dimensions in millimeters by way of example.

Another preferred embodiment of the invention also incorporates in the semi-circular support structures outer horizontal ribs on their upper portion joining the continuous ribs that copy the arch shape in certain zones and also incorporate on the floor supports, certain vertical slits on the semi-circular support structures at both sides, such that when said semi-circular support structures are manufactured in molding machines, and are stacked orthogonally, on each other in layers aligned, these horizontal ribs match positionally to the aforementioned vertical slits, locking the parts supported upon one another, giving stability to the pile of parts; these outer horizontal ribs are shown in the center view of FIG. 10, while the upper view of FIG. 10 shows vertical slits at one side of the semi-circular support structure.

The longitudinal ends of the support structures have been reinforced to better support the bumps and scratches produced by the forks of the forklifts when they enter into the structure no perfectly parallel or at an undue height.

The reinforcement is basically the general thickening of the walls of the structures in the above areas, in a longitudinal extension of 100 mm, and a thickening of about 50% of the thickness wall, to the inside of the shape.

Also there are provided three ribs at an angle of 45°, from the upper portion of the inlet to the end of the first inner horizontal rib. These forms prevent the first horizontal rib and following from being bumped by the forks of the forklift in case of entering at an incorrect height.

Figure 18:
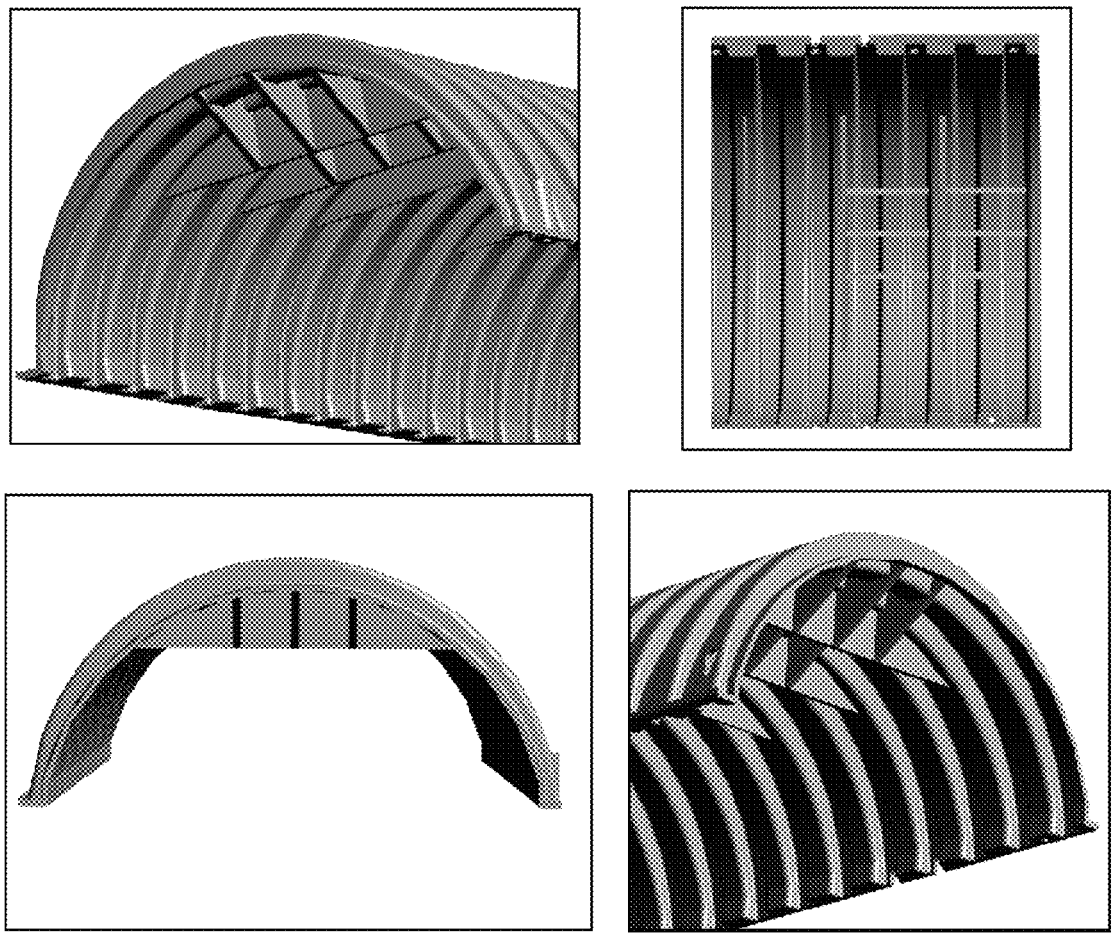
FIG. 18 shows the longitudinal ends of the support structures that have been reinforced to better support the bumps and scratches produced by the forks of the forklifts when they enter into the structure no perfectly parallel or at an undue height.

In this case, the fork will push the angled face of the ribs, that will work as inclined plane, producing an upward movement of the support structure, that can be appreciated by the driver of the lift fork and corrected immediately slightly lowering the forks. These three ribs at an angle of 45° can be seen in the drawings of FIG. 18.

Another preferred embodiment of the invention comprises a method of assembly of the ecological pallet that comprises the following steps:

i) take a fabric web, that may be a raffia cloth, already conveniently pierced with 6 lines of successive openings made at equidistant intervals and the first double male anchoring members with the pins at the first line of coincident openings are placed, more than one double male anchoring member can be used such that all the openings of the fabric web are traversed by the head of a pin of the first double male anchoring members;

ii) fold the fabric web, wrapping the first double male anchoring member, to pass pins of the opposite side through the second line of openings of the fabric web;

iii) take a semicircular support structure and match with the side having the specially shaped openings with the line of pins already wrapped in the web;

iv) engage the pins in the special openings of the semicircular support structure;

v) wrap one of the two semicircular support structures with the fabric web, starting from the side where the first double anchoring male members are anchored to the lower portion of the semicircular support structure and then to the top, returning to the pins protruding from the openings of the fabric web;

vi) pass the protruding pins through the third line of openings of the fabric web;

vii) take the first female anchoring member with openings and align it to the protruding pins of the fabric web, and engage the pins in the openings of the first anchoring member/s;

viii) repeat the process for the other end of cloth web, the other semi-circular support structure and the corresponding second double male and female anchoring member/s, to obtain the assembled ecological pallet.

Figure 17:
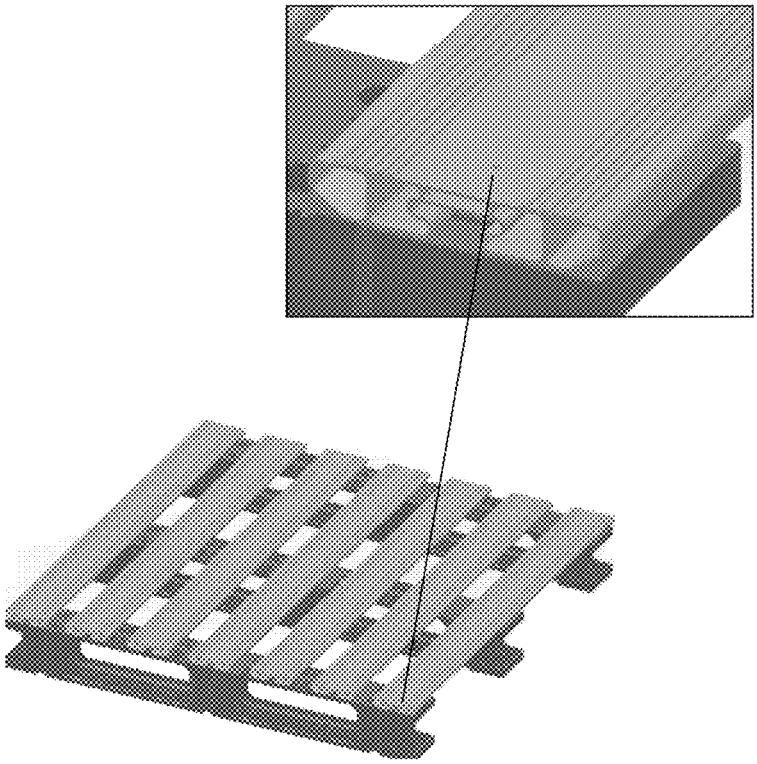
FIG. 17 shows a plastic pallet with a detail of the opening to insert the moveable plastic pin with of the ecological pallet.

El above method further comprises fixing to a plastic or wooden pallet by cylindrical pins located within the cylindrical housing on the ends of the semi-circular support structures, wherein said cylindrical pins project from the ecological pallet and are inserted in the openings corresponding to the plastic or wooden pallet to prevent it from moving during transportation or loading. FIG. 17 shows an example of the plastic pallet to this end.

Justification of Choice of Methods of Production and Elements

Raffia:

It is preferred a polypropylene web of raffia as it is a material produced in Argentina and different countries where the ecological pallet can be exported to, so it is convenient to use local materials, readily available, with a high tensile strength.

The process of sewing a material such as raffia generated logistical and quality problems, as being a semi artisan production, depended on the hand of the operator to achieve a consistent quality, generating differences between units, resulting in many inconveniences at the time of assembly of the pallet, this drawback is prevented by the use of the ecological pallet described herein that has no seams.

Also stitching causes trouble at the time of recycling the units used, as the threads can be of different materials (polyamide, polyester) that contaminate the polypropylene.

Also it was difficult to repair a pallet with small breaks, as it is impossible to sew it again and very difficult to disassemble.

The way to solve the problem of sewing of raffia used in the background art is the assembly system by openings and mechanical engagement that streamlines the assembly, avoids differences between units and allows an easy and quick disassembly and reassembly.

Different Injected Semicircular Support Structures of Folded or Extruded Sheets:

Basically, the existing systems of similar prior art pallets work with solid or foamed sheet folded, being tensioned in the container pocket. This causes frequent breaks of pocket and its seams, besides the product is not perfectly defined, the always vary among the articles as the sheets fit in the pocket.

Firstly it was used a extrusion of a half round shape profile which is a variation of the embodiment, but it was found that the injected form would allow to incorporate outer and inner ribs, and special shapes to attain higher load resistances.

This in turn allowed savings in thicknesses, the use or smaller amounts of material and the chance to use different materials to the same end.

Two cavities are mold projected to attain a high production of semi-circular support structures.

The stacked semi-circular support structures have side slots that combine with outer longitudinal ribs at the highest point of the formed arc, so as to lock the pieces when stacked on a pallet, crossed on each other. This allows a stable and transportable stacking without need of strapping or wrapping the pallet.

Anchoring Members:

The double male and female anchoring members necessary for fixing the web, for example made of raffia, will be injection molded with the same material of the semi-circular support structures, in order to attain the same post-molding contraction in all the parts and enhanced assembly accuracy.

To reduce the dimensions of the mold and the size of the machine to produce the same, and to minimize post-molding contraction effect, the anchoring members can be designed in two or more pieces shaped to cover the entire length of the semi-circular support structure. It is preferred that the anchoring members are formed by two pieces for each type of anchoring members in order to cover the total length of each semi-circular support structure.

It is noted that the number of openings the semi-circular support structure has will be equal to the openings of the female anchoring member and equal to the total number of pins of the double male anchoring member and equal to the total number of openings of each line of openings of the fabric web.

Ribs at the Inlets of the Support Structures:

The longitudinal ends of the support structures can be reinforced to better support the bumps and scratches produced by the forks of the forklifts when they enter into the structure no perfectly parallel or at an undue height.

The reinforcement is basically the general thickening of the walls of the structures in the above areas, in a longitudinal extension of 100 mm, and a thickening of about 50% of the thickness wall, to the inside of the shape.

Also it is possible to provide three ribs at an angle of 45°, from the upper portion of the inlet to the end of the first inner horizontal rib. These forms prevent the first horizontal rib and following from being bumped by the forks of the forklift in case of entering at an incorrect height.

In this case, the fork will push the angled face of the ribs, that will work as inclined plane, producing an upward movement of the support structure, that can be appreciated by the driver of the lift fork and corrected immediately slightly lowering the forks.

Various modifications and alternatives to the invention will be apparent to those skilled in the art without departing from the spirit or scope thereof.

Therefore, it is understood that the present invention encompasses the modifications and alternatives that fall within the scope of the attached claims and its equivalents.

What is claimed is:

1. An ecological pallet comprising two semi-circular support structures, which are elongated arch-shaped structures, with openings located at equidistant distances on one of the sides of each of said semi-circular support structures, wherein said semi-circular support structures are connected to each other by a fabric web wherein the fabric web is fixed through parallel opening lines to each of the support structures by:

(i) one or more first and second double male anchor type member with pins, which have a head and body and extending on both sides of said double male anchoring members keeping between the pins the same equidistant distances to each other that keep the openings of the semi-circular support structures, and (ii) one or more first and second female anchoring members with equidistant openings keeping between the openings the same equidistant distances to each other that keep the openings of the semi-circular support structures, wherein the openings of the one or more first and second female anchoring member and the openings of each of the two semi-circular support structures engage on the pins to each side of the one or more first and second double male anchoring member respectively.

2. The ecological pallet according to claim 1, wherein the one or more first anchoring member fixes the fabric web to a semi-circular support structure and the one or more second anchoring member fixes the fabric web to the other semi-circular support structure.

3. The ecological pallet according to claim 2, wherein the fabric web comprises 6 parallel opening lines wherein each opening is equidistant to the following within each of the lines so as to keep the same equidistant distances to each other that keep the openings on one of the sides of the semi-circular support structures.

4. The ecological pallet according to claim 3, wherein the spacing between the centers of the openings between the first and second line of openings on one end of the fabric web is equal to the spacing between the centers of the openings between the fifth and sixth line of openings on the other end of the fabric web and is equal to the width of the double male anchoring member/s added to the thickness of said anchoring member/s when the pins are centered on the sides of said double male anchoring member.

5. The ecological pallet according to claim 4, wherein the first and second line of openings on a first end of the fabric web is traversed by the pins at both sides of the one or more double male first anchoring member respectively being said first double male anchoring member/s wrapped by said first end of the fabric web, and in the same way, the fifth and sixth line of openings of the other end of the fabric web is traversed by the pins at both sides of one or more second double male anchoring member respectively being said second double male anchoring member/s wrapped by said second end of the fabric web.

6. The ecological pallet according to claim 5, wherein the pins projecting through the first line of outermost openings of an end of the fabric web engage on the equidistant openings of one of the two semi-circular support structures and the pins projecting through the sixth line of outermost openings of the other end of the fabric web engage on the equidistant openings of the other semi-circular support structure.

7. The ecological pallet according to claim 6, wherein the first end of the fabric web wraps the first semi-circular support structure, that is an arc-shaped elongated structure, going first underneath the base of the arch and then above the arch engaging the third line of equidistant openings of the fabric web on the projecting pins of the one or more double male first anchoring member at the side that does not engages to the semi-circular support structure and in the same way, the second end of the fabric web wraps the second semi-circular support structure, that is an arc-shaped elongated structure, going first underneath the base of the arch and then above the arch engaging the fourth line of openings of the fabric web on the projecting pins of one or more second double male anchoring member at the side that does not engages to the other semi-circular support structure.

8. The ecological pallet according to claim 7, wherein the one or more first female anchoring member engages to the pins projecting through the third line of openings of the fabric web and one or more second female anchoring member engages to the pins projecting through fourth line of openings of the fabric web.

9. The ecological pallet according to claim 3, wherein the spacing between the opening centers between the first line of openings and the closest end of the fabric web is equal to the spacing between the opening centers between the sixth line of openings and the other end of the fabric web and is equal to half the width of the double male anchoring member.

10. The ecological pallet according to claim 3, wherein the spacing between the opening centers between the second line of openings and the third line of openings of the fabric web is equal to the spacing between the fourth line of openings and the fifth line of openings of the fabric web and is equal to the outer diameter of the semi-circular support structures added to the length of the outer arch of semi-circular support structures.

11. The ecological pallet according to claim 1, wherein the fabric web is made of raffia.

12. The ecological pallet according to claim 1, wherein the first and second double male or female anchoring member/s as well as the two support structures are made of polypropylene or high density polyethylene.

13. The ecological pallet according to claim 1, wherein the equidistant openings both the two semi-circular support structures as the one or more first and second female anchoring member have a special shape having in the upper portion a larger diameter that allows the passage of the pin heads of the double male anchoring members and the lower portion has a smaller diameter that allows the passage of the body of said pins, and on the middle portion a passage necking so that going the head through the upper portion and taking the pin to the lower portion, resistance to the passage in the aforementioned necking is provided, that when beaten allows housing of the body of the pins and generates a resistance to move to the upper portion and release.

14. The ecological pallet according to claim 13, wherein the semi-circular support structures also have cylindrical housings on their ends at the side opposite to the openings located at equal distances, that contain cylindrical pins allowing attachment on another pallet.

15. The ecological pallet according to claim 14, wherein the cylindrical pins have a larger diameter, a smaller diameter and a small bulge on the end of the smaller diameter, the larger diameter is within the housing to guide the ends of the cylindrical semicircular support structures, the smaller diameter retractably protrudes from the platform to leave a bolt on each corner of the same that matches four openings at the corners of another wooden or solid plastic pallet, to set the platform on the same, the bulge on the end of the portion of smaller diameter is to prevent retraction of pin limiting its stroke.

16. The ecological pallet according to claim 1, wherein the two semi-circular support structures have a series of parallel continuous ribs that copy the shape of the arch to improve its stiffness.

17. The ecological pallet according to claim 1, wherein the two semi-circular support structures have inner horizontal ribs that cross and link the inner upper portion of the arcs and reinforce the load resistance of the structure.

18. The ecological pallet according to claim 17, wherein the two semi-circular support structures have reinforcements that correspond to a thickening of about 50% of the thickness of the wall in the longitudinal ends and the incorporation of three ribs at an angle of 45° that range from the upper portion of the inlet to the end of the first inner horizontal rib.

19. The ecological pallet according to claim 17, wherein inner horizontal ribs together form a virtual plane to allow better contact and support of the forklift forks.

20. The ecological pallet according to claim 1, wherein the semi-circular support structures also have outer horizontal ribs on its upper portion joining the continuous ribs that copy the arch shape in certain zones and also incorporate the floor supports certain vertical slits at both sides of the semi-circular support structures, such that when said semi-circular support structures are manufactured in molding machines, and the parts are stacked orthogonally on each other in layers aligned, these horizontal ribs match positionally to the aforementioned vertical slits, locking the parts supported upon one another, giving stability to the pile of parts.

21. The ecological pallet according to claim 1, wherein the one or more double male first anchoring member/s and the one or more first female anchoring member/s comprise two double male anchoring members and two female anchoring members respectively.

22. The ecological pallet according to claim 1, wherein the second double male anchoring member/s and the second female anchoring member/s comprise two double male anchoring members and two female anchoring members respectively.

23. A method of assembly of an ecological pallet according to claim 1, the method comprising the following steps:

i) take a fabric web, that may be a raffia cloth, already conveniently pierced with 6 lines of successive openings made at equidistant intervals and the first double male anchoring members with the pins at the first line of coincident openings are placed, more than one double male anchoring member can be used such that all the openings of the fabric web are traversed by the head of a pin of the first double male anchoring members;

ii) fold the fabric web, wrapping the first double male anchoring member, to pass pins of the opposite side through the second line of openings of the fabric web;

iii) take a semicircular support structure and match with the side having the specially shaped openings with the line of pins already wrapped in the web;

iv) engage the pins in the special openings of the semicircular support structure;

v) wrap one of the two semicircular support structures with the fabric web, starting from the side where the first double anchoring male members are anchored to the lower portion of the semicircular support structure and then to the top, returning to the pins protruding from the openings of the fabric web;

vi) pass the protruding pins through the third line of openings of the fabric web;

vii) take the first female anchoring member with openings and align it to the protruding pins of the fabric web, and engage the pins in the openings of the first anchoring member/s;

viii) repeat the process for the other end of cloth web, the other semi-circular support structure and the corresponding second double male and female anchoring member/s, to obtain the assembled ecological pallet.

24. A method of assembly of an ecological pallet according to claim 23, further comprising fixing to a plastic or wooden pallet by cylindrical pins located within the cylindrical housing on the ends of the semi-circular support structures, wherein said cylindrical pins project from the ecological pallet and are inserted in the openings corresponding to the plastic or wooden pallet to prevent it from moving during transportation or loading.

* * * * *